US005167540A

United States Patent [19]

Mooz

[11] Patent Number: 5,167,540

[45] Date of Patent: Dec. 1, 1992

[54] SAFETY CONNECTION DEVICE FOR ENCASED MEDIUM-VOLTAGE SWITCHING DEVICES

[75] Inventor: Dietrich Mooz, Krefeld, Fed. Rep. of Germany

[73] Assignee: Felten & Guilleaume Energietechnik GmbH, Cologne, Fed. Rep. of Germany

[21] Appl. No.: 396,382

[22] Filed: Aug. 18, 1989

Related U.S. Application Data

[63] Continuation of Ser. No. 726,223, Apr. 22, 1985, abandoned.

[30] Foreign Application Priority Data

Apr. 21, 1984 [DE] Fed. Rep. of Germany ..... 3415047

[51] Int. Cl.[5] ..... H01R 13/68

[52] U.S. Cl. ..... 439/621; 337/187

[58] Field of Search ..... 439/621, 622; 337/187, 337/201

[56] References Cited

U.S. PATENT DOCUMENTS

| | | | |
|---|---|---|---|
| 2,187,427 | 1/1940 | Middleton | 337/201 |
| 2,386,060 | 10/1945 | Powell | 337/187 |
| 3,377,610 | 4/1968 | Busch et al. | 439/441 |
| 4,178,061 | 12/1979 | Ahroni | 439/622 |

FOREIGN PATENT DOCUMENTS 3244424 6/1984 Fed. Rep. of Germany .

*Primary Examiner*—Gary F. Paumen
*Attorney, Agent, or Firm*—Michael J. Striker

[57] ABSTRACT

A safety connection device for connecting a high rupture capacity fuse link to a switching device and includes at least one connecting element having one opening receiving a guide carrying a cable from the switching device and another opening which receives the fuse link, and a contact spring and a contact bracket connected to each other and also connected to the fuse link and to the end of the cable inserted into the connecting element, respectively. The diameter of the opening receiving the fuse link is substantially greater than that of the fuse link.

4 Claims, 1 Drawing Sheet

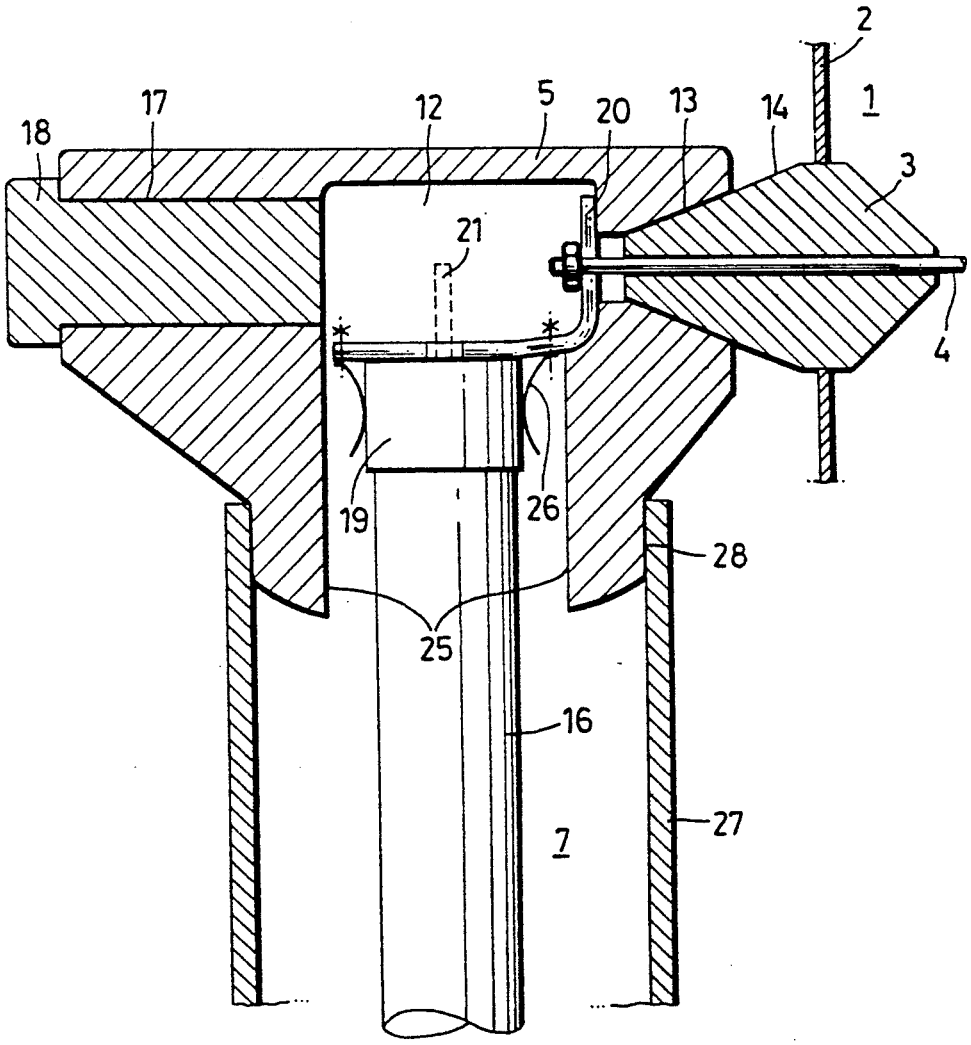
2
1
17
12
5
20
13
14
18
3
21
4
19
26
28
25
16
27
7

SAFETY CONNECTION DEVICE FOR ENCASED MEDIUM-VOLTAGE SWITCHING DEVICES

This is a continuation of application Ser. No. 726,223 filed Apr. 22, 1985, now abandoned.

BACKGROUND OF THE INVENTION

The present invention relates to a safety connection device for encased medium-voltage switching devices by means of the insertion of a High Rupture Capacity Fuse Link (HH-safety). For this purpose usually two connecting elements are provided. The electric connection of the High Rupture Capacity Fuse Link to the switching device on the one hand, and to the connection cable, on the other hand,is obtained by means of contact elements positioned in the connecting element The construction of the connecting element,however,-makes an exchange of the High Rupture Capacity Fuse Link problematic and furthermore a required rigging can be affected.

SUMMARY OF THE INVENTION

It is an object of the present invention to provide improved safety connection device.

It is another object of this invention to provide a connection device, in which the insertion and exchange of the High Rupture Capacity Fuse Link would be facilitated and voltage-resistance would be enhanced.

These and other objects of the invention are attained by a safety connection device for encased medium voltage switching devices, comprising a guide for guiding a removably-insert cable into a wall of the switching device; a connect element set on said guide, said connecting element including a recess receiving an end of said cable, an opening, into which High Rupture Capacity Fuse Link is inserted; contact means for connecting an end of said fuse to the end of said cable, the diameter of said opening being substantially greater than the diameter of said safety cartridge, said conta means including a contact spring and a contact bracket connect to said, spring,said spring being in contact with the end of said fuse, said bracket being also connected to the end o said cable; and a tubular member made of plastics and surrounding said fuse at a radial distance therefrom, said connecting element being formed of rubber elastic material and having a peripheral surface to which said tubular element is connected.

The tubular element may be made of transparent material.

The connecting element may include a further conical opening receiving said guide, said guide having a conical outer surface matching said conical opening.

The connecting element may include yet another opening opposite to said conical opening and receiving a plug therein.

The advantage of the safety connection device reside in that the enlarged openings provided in the connecting element significantly facilitate the insertion of the High Rupture Capacity Fuse Link as well as their interchange. Due to t omission of outer conductive coatings on the connecting element they are grounded at suitable places,and the omission of such coatings in the interior of each connecting element permits on to avoid high field intensities and to facilitate manufacturing of connecting elements. A required rigging is obtained by a sealed joint between each connecting element and the tubular element of plastics.

The novel features which are considered as characteristic for the invention are set forth in particular in the appe claims. The invention itself, however, both as to its construction and its method of operation, together with additional obje and advantages thereof, will be best understood from the following description of specific embodiments when read in connection with the accompanying drawing.

BRIEF DESCRIPTION OF THE DRAWING

The sole figure of the drawing illustrates a section view through a safety connection device.

DETAILED DESCRIPTION OF THE PREFERRED EMBODIMENT

Referring now to the drawing in detail reference numeral 2 designates a wall of a switching device 1,into which a guide 3 for a cable lead 4 is inserted. The purpose of the guide 3 is to lead cable 4 from the interior of the switching device to a High Rupture Capacity Fuse Link 7. A connecting element 5 serves for the connection between the guide 3,and the High Rupture Capacity Fuse Link 7. The connecting element 5 has a conical opening 13,at the side of the switching device. Guide 3 which has a respective conical periphery 14, matching the opening 13 is plugged into this opening. The connecting element 5 has an inner space 12 which opens into three opening one of which is the above described opening 13, another is an opening 17 which extends opposite to the conical opening, and a vertical opening 25.

To ensure a rigid seat of the connecting element on the guide 3 a cable lead 4 is provided at its end within inner space 12 with a bracket or yoke 20 which is supported against the inner side wall of the supporting element, defining the interior space 12, and is rigidly secured in the connecting device by a bolt-nut connection. The bracket serves the purpose of connecting the cable lead and a contact cap 19 of a shaft 16 of the, fuse link 7. The second opening 17 of the connecting element receives a detachable plug 18. A position or condition of a solder pin 21 can be observed through the opening 17 when plug 18 is removed therefrom; in other words it is easy to examine any time whether or not safety device operates.

The third opening 25 receives the fuse link. The diameter of opening 25 is substantially greater than the diameter of the shaft 16. The cont between the contact bracket 20 and the contact cap 19 is established by a contact spring 26 which is screwed to the contact bracket.

A number of connecting elements can be suspended on and connected to the switching device in the same fashion as connecting element 5. The connection between different connect elements is established by a tube 27 made of plastics. Tube 27 can be made of transparent material. The joint between the connecting elements and tube 27 is obtained at a common sealing surface 28 which sealingly encloses a respective peripheral surface of the connecting element.

It will be understood that each of the elements described above, or two or more together, may also find a useful application in other types of safety connection devices differing from the types described above.

While the invention has been illustrated and described as embodied in a safety connection device for switching apparatus it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety connection device for encased medium voltage switching devices, comprising a guide for guiding a cable removable from and insertable into a wall of the switching device; a connecting element set on said guide, said connecting element including a recess receiving an end of said cable, an opening, into which a High Rupture Capacity Fuse Link is inserted; contact means for supporting an end of said fuse link in said connecting element at a distance from a wall of said opening and for connecting said end of said fuse link to the end of said cable, the diameter of said opening being substantially greater than the diameter of said fuse link, said contact means including a contact spring surrounding a portion of said fuse link and being in contact therewith, and a contact bracket connected to said spring, said spring being in contact with the end of said fuse link, said bracket being also connected to the end of said cable; and a tubular member made of plastics and surrounding said fuse link at a radial distance therefrom, said connecting element being formed of a rubber elastic material and having a peripheral surface to which said tubular element is connected, whereby conductive coating are not required on said connecting element.

2. The device as defined in claim 1, wherein said tubular element is made of transparent material.

3. The device as defined in claim 1, wherein said connecting element includes a further conical opening receiving said guide, said guide having a conical outer surface matching said conical opening.

4. The device as defined in claim 3, wherein said connecting element includes yet another opening opposite to said conical opening and receiving a plug therein.

* * * * *